US012258714B2

(12) United States Patent
Ko et al.

(10) Patent No.: US 12,258,714 B2
(45) Date of Patent: Mar. 25, 2025

(54) ARAMID PULP AND METHOD FOR MANUFACTURING THE SAME

(71) Applicant: KOLON INDUSTRIES, INC., Seoul (KR)

(72) Inventors: Changhee Ko, Seoul (KR); Namdae Gu, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 416 days.

(21) Appl. No.: 17/775,899

(22) PCT Filed: Dec. 24, 2020

(86) PCT No.: PCT/KR2020/019048
§ 371 (c)(1),
(2) Date: May 11, 2022

(87) PCT Pub. No.: WO2021/137524
PCT Pub. Date: Jul. 8, 2021

(65) Prior Publication Data

US 2022/0389660 A1 Dec. 8, 2022

(30) Foreign Application Priority Data

Dec. 31, 2019 (KR) ..... 10-2019-0179689
Dec. 14, 2020 (KR) ..... 10-2020-0174805

(51) Int. Cl.
*D21H 13/26* (2006.01)
*D21C 3/26* (2006.01)
(Continued)

(52) U.S. Cl.
CPC ..... *D21H 13/26* (2013.01); *D21C 3/26* (2013.01); *D21D 1/20* (2013.01); *D21H 17/55* (2013.01)

(58) Field of Classification Search
CPC ..... D21H 13/26; D21H 17/55; D21C 3/26; D21D 1/20
See application file for complete search history.

(56) References Cited

U.S. PATENT DOCUMENTS 4,873,144 A 10/1989 Marshall
5,250,633 A 10/1993 Calundann
(Continued)

FOREIGN PATENT DOCUMENTS

CN 101440589 B * 1/2011
CN 107849813 A 3/2018
(Continued)

OTHER PUBLICATIONS

English machine translation of WO2016047764A1 (Year: 2006).*
English machine translation CN101440589BI, 2011 (Year: 2011).*
English machine translation KR20100111913A, 2010. (Year: 2010).*

*Primary Examiner* — Anthony Calandra
(74) *Attorney, Agent, or Firm* — Harvest IP Law, LLP

(57) ABSTRACT

According the present disclosure, there is provided an aramid pulp and a method for manufacturing the same, in which a completely dried, oilless aramid yarn that has not been applied with a general spinning oil agent is used, and thus the water dispersion and swelling time of the fiber can be reduced as compared with a conventional case, thereby providing an aramid pulp that is improved in productivity and pulp properties and excellent in interfacial adhesion force with different materials.

5 Claims, 6 Drawing Sheets

(51) Int. Cl.
*D21D 1/20* (2006.01)
*D21H 17/55* (2006.01)

(56) References Cited

U.S. PATENT DOCUMENTS

| | | | |
|---|---|---|---|
| 2003/0022961 | A1 | 1/2003 | Kusaka |
| 2005/0284595 | A1 | 12/2005 | Conley |

FOREIGN PATENT DOCUMENTS

| | | | | | |
|---|---|---|---|---|---|
| EP | 3305982 | A2 | | 4/2018 | |
| JP | S63-135515 | A | | 6/1988 | |
| JP | S63-165514 | A | | 7/1988 | |
| JP | S63-190087 | A | | 8/1988 | |
| JP | H03-206119 | A | | 9/1991 | |
| JP | H04-2814 | A | | 1/1992 | |
| JP | H07108119 | A | | 4/1995 | |
| JP | 2002284903 | A | | 10/2002 | |
| JP | 2010-502854 | A | | 1/2010 | |
| JP | 2011058117 | A | | 3/2011 | |
| JP | 2018-515697 | A | | 6/2018 | |
| JP | 2019-523838 | A | | 8/2019 | |
| KR | 2009-0114570 | A | | 11/2009 | |
| KR | 20100035329 | A | | 4/2010 | |
| KR | 20100100424 | A | | 9/2010 | |
| KR | 20100108976 | A | | 10/2010 | |
| KR | 20100111866 | A | | 10/2010 | |
| KR | 20100111913 | A | * | 10/2010 | ..... D21H 13/26 |
| KR | 101071862 | B1 | | 10/2011 | |
| KR | 10-1360988 | B1 | | 2/2014 | |
| KR | 20150041313 | A | | 4/2015 | |
| KR | 101519466 | B1 | | 5/2015 | |
| WO | 2003-093576 | A1 | | 11/2003 | |
| WO | WO-2016047764 | A1 | * | 3/2016 | ..... B32B 29/00 |

* cited by examiner

【FIG. 1】
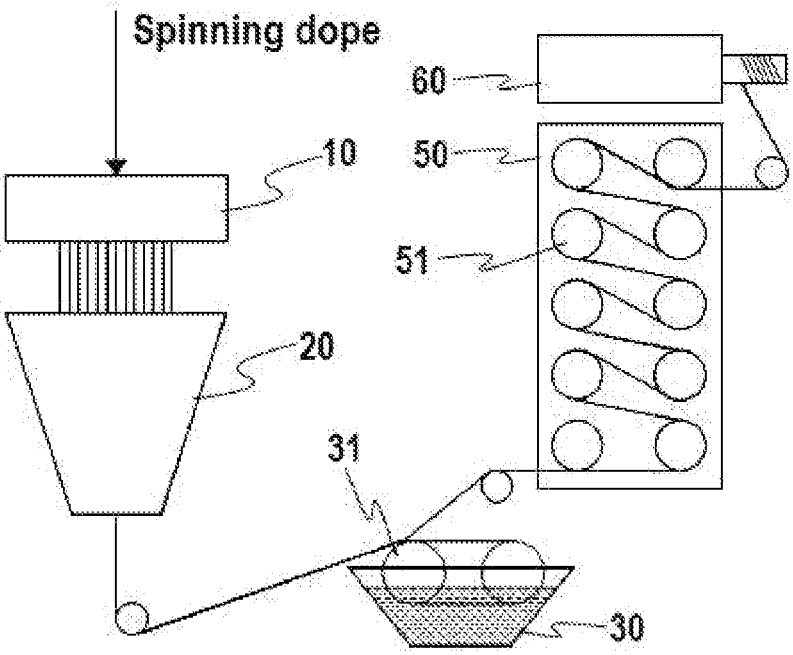
【FIG. 2】
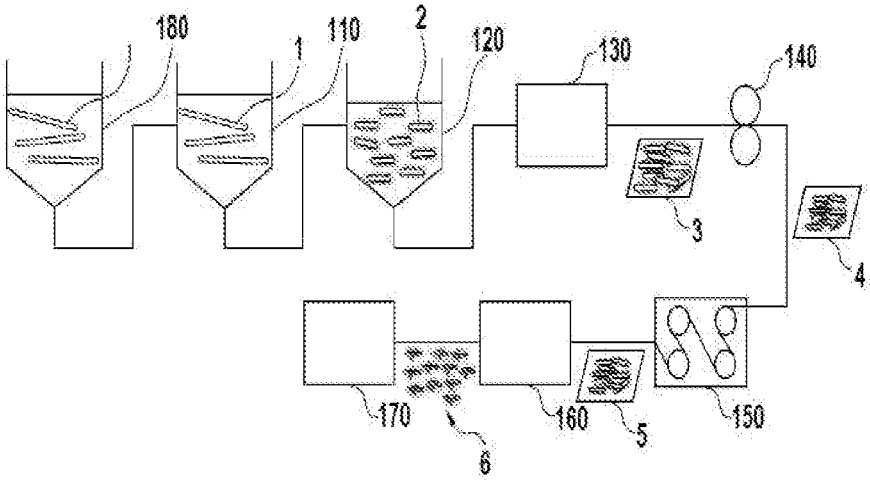

【FIG. 3】
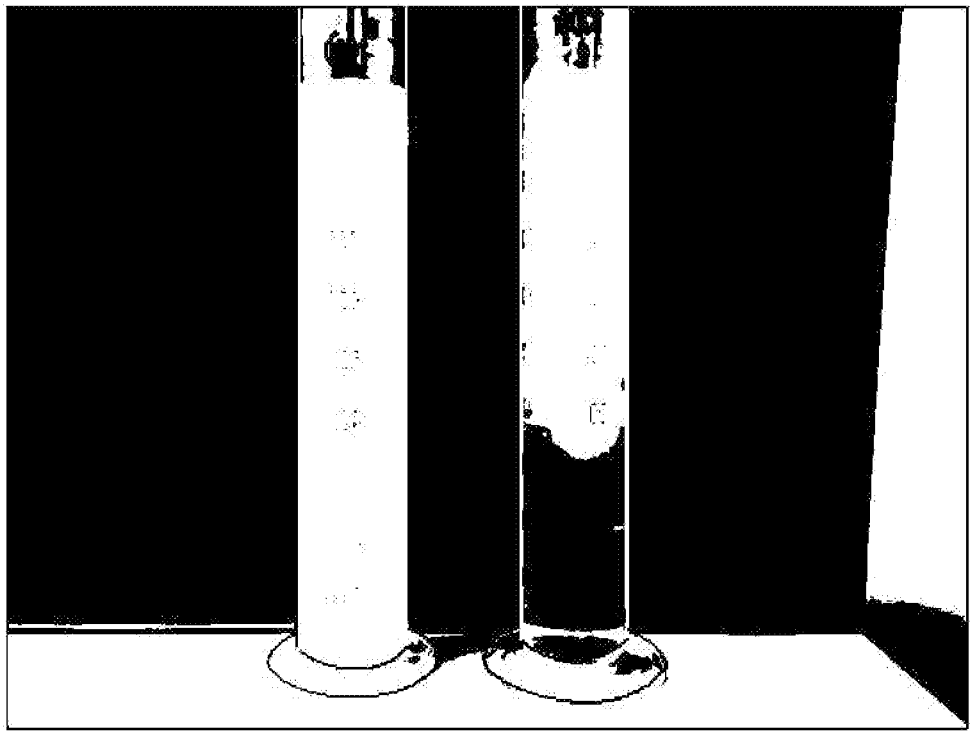
Example 1 Comparative Example 1

【FIG. 4a】
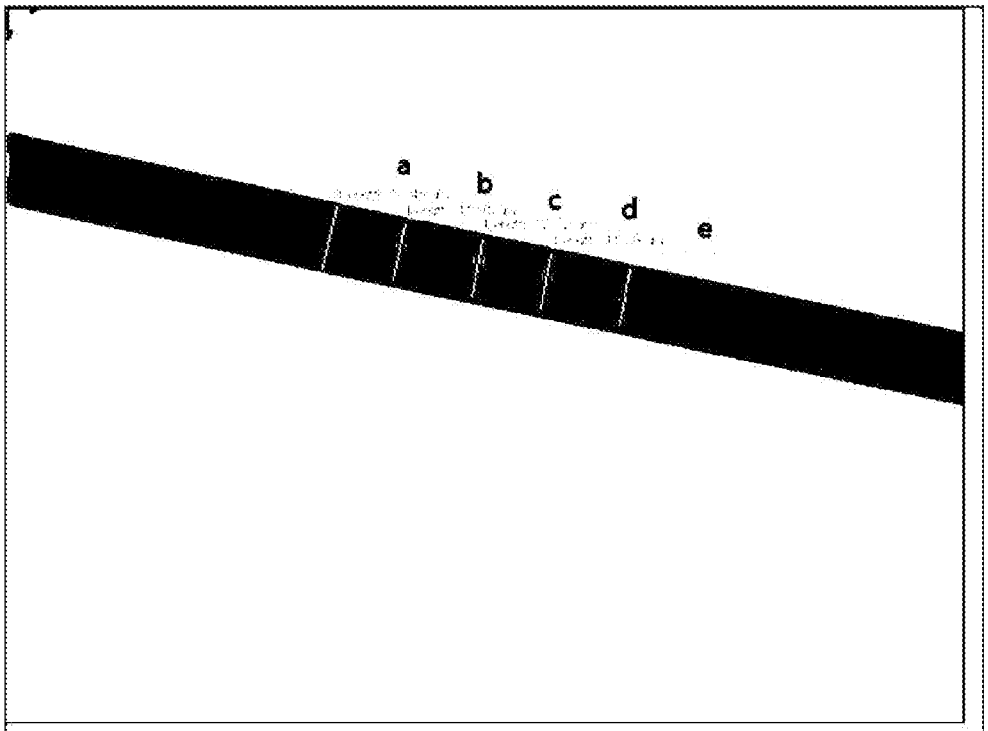
a: 12.45um, b: 11.91um, c: 12.32um, d: 11.89um e: 11.91 um
(Example 1)

【FIG. 4b】
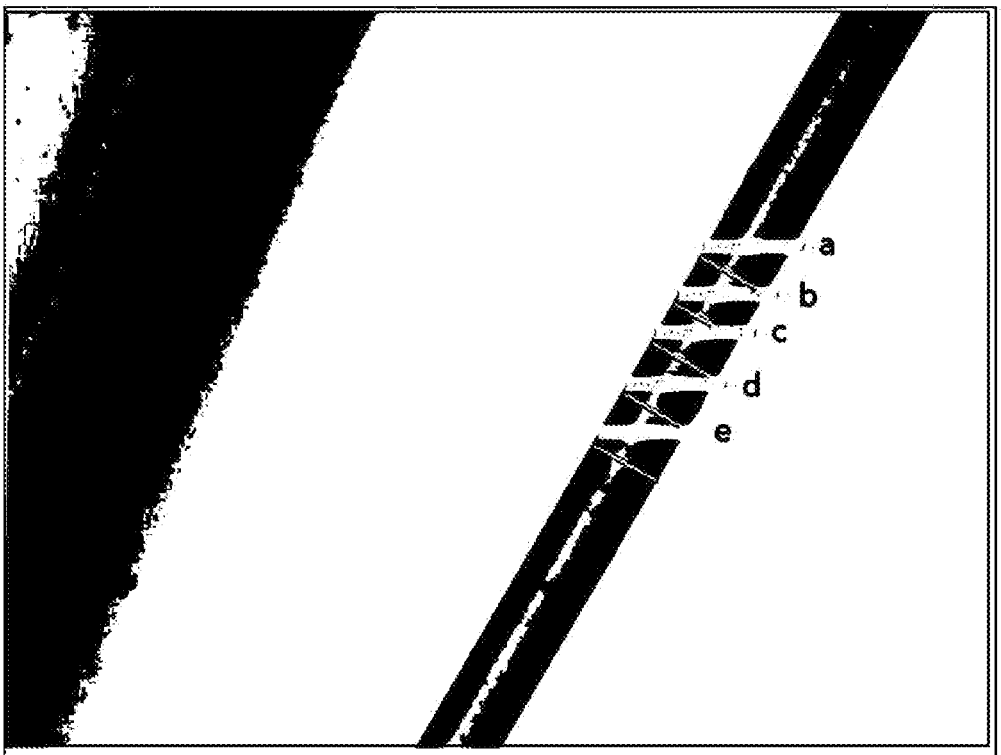
a: 13.11um, b: 12.66um, c: 12.84um, d: 12.899um, e: 12.95um
(Comparative Exmaple 1)

【FIG. 5】
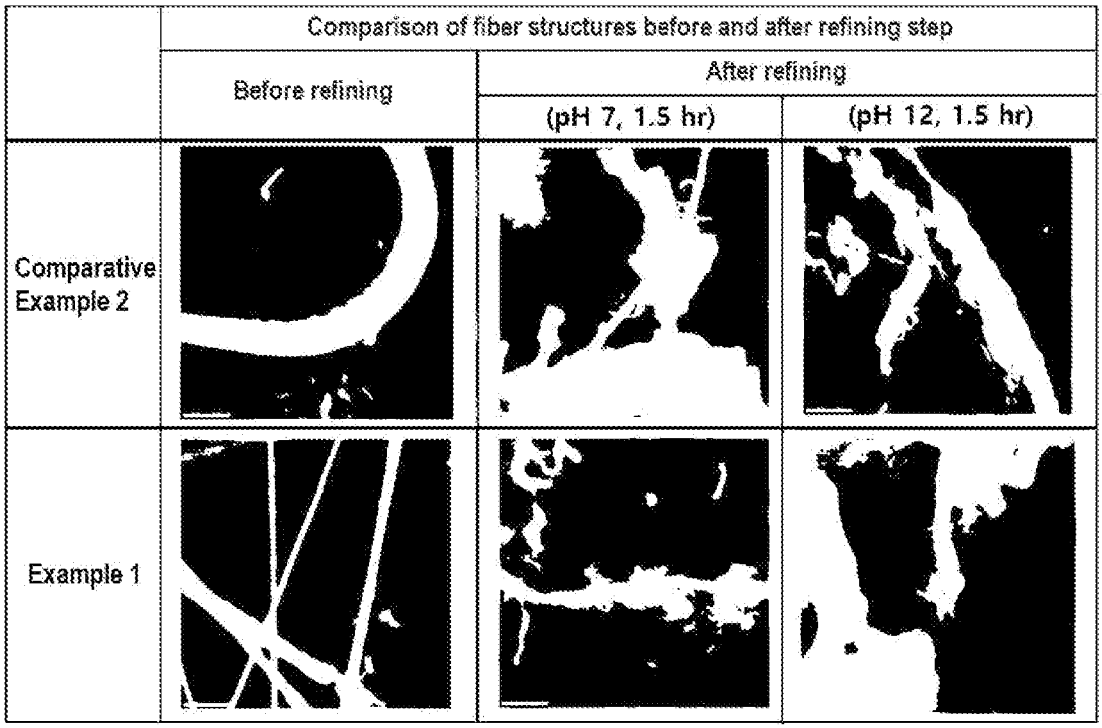

【FIG. 6】
| | Fiber photography (USB 200X) | Orientation angle | Crystallinity | Size |
|---|---|---|---|---|
| Comparative Exmaple 2 | 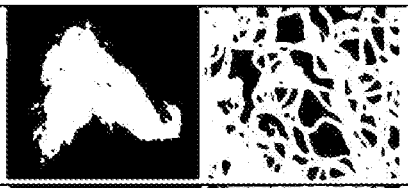 | XRD Unmeasurable | XRD Unanalyzable | Dia 85 μm |
| Example 1 | 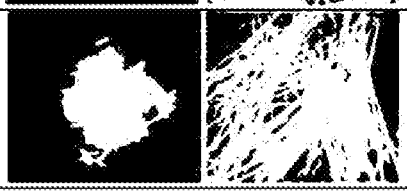 | 7~12° | 75% | Dia 12 μm |

ARAMID PULP AND METHOD FOR MANUFACTURING THE SAME

TECHNICAL FIELD

Cross-Reference to Related Application(s)

This application is a National Stage of International Application No. PCT/KR2020/019048 filed on Dec. 24, 202, claiming the benefit of Korean Patent Application No. 10-2019-0179689 filed on Dec. 31, 2019 and Korean Patent Application No. 10-2020-0174805 filed on Dec. 14, 2020 in the Korean Intellectual Property Office, the contents of which are incorporated herein by reference in their entirety.

The present disclosure relates to an aramid pulp having improved productivity and physical properties by using oilless yarn, and a method for manufacturing the same.

Background Art

Fibrous and non-fibrous reinforcement materials have been used for many years in friction products, sealing products, and other plastic or rubber products. Such reinforcement materials typically must exhibit high wear and heat resistance.

Asbestos fibers have been generally used as fibrous reinforcement materials, but it has been found to be harmful to the human body, and its use is prohibited. Therefore, various alternatives to asbestos fibers have been proposed, and among them, one of the most noteworthy things is an aramid pulp produced using aramid fibers. The aramid pulp is used as a reinforcement material for various articles, and for example, it is widely used as reinforcement materials for brake pads, clutches, gaskets, and the like.

Further, the aramid pulp is generally manufactured by a process of producing an aramid yarn containing an oil, then cutting the aramid yarn, dispersing the cut aramid yarn in water (slurring), and then wet refining.

That is, the aramid fiber is produced though a process including: a step of polymerizing an aromatic diamine and an aromatic diacid halide in a polymerization solvent containing N-methyl-2-pyrrolidone to prepare a wholly aromatic polyamide polymer, a step of dissolving the polymer in a concentrated sulfuric acid solvent to prepare a spinning dope, a step of spinning the spinning dope through a spinneret and then passing the spun product through a non-coagulating fluid and a coagulation bath in sequence to produce a filament, and a step of washing and drying the filament. Subsequently, a spinning oil agent is coated onto the fiber surface of the dried filaments using an oil feed roller and wound to produce an aramid fiber as a raw yarn.

However, the oil agent coated on the aramid raw yarn interferes with water dispersion, and swelling and refining of the raw yarn, which interferes with fibril expression, which is a key property of the aramid pulp. Thereby, when manufacturing brake pads and gaskets, which are the main uses of aramid pulp, there is a problem of weakening interfacial adhesion force with different materials.

Therefore, conventionally, in order to remove the oil agent, there is a method for reducing the residual content of the oil agent in the pulp to 0.5% by weight or less by using high frequency, sulfuric acid, alkali, etc. during pulp production. However, since the above method requires a separate means of removing the oil agent in the process of manufacturing the pulp, the process is complicated and the oil agent still remains. Therefore, there is a limit to improving the interfacial adhesion force of the aramid fiber composite combined with a dissimilar material.

DETAILED DESCRIPTION OF THE INVENTION

Technical Problem

It is an object of the present disclosure to provide a high-quality aramid pulp that can increase the specific surface area using an oilless aramid yarn, has excellent interfacial adhesion force with different materials, and is improved in productivity and physical properties, and a method for manufacturing the same.

Technical Solution

According to an embodiment of the present disclosure, there is provided an aramid pulp characterized in that it is formed from an oilless aramid short fiber of dried multifilaments that are not coated with a spinning oil agent.

According to another embodiment of the present disclosure, there is provided a method for manufacturing the aramid pulp, the method including the steps of:

providing an oilless aramid short fiber;

preparing a water dispersion slurry of the oilless aramid short fiber; and refining the water dispersion slurry, wherein the oilless aramid short fiber are produced by a method which includes spinning and coagulating a spinning dope using an aromatic polyamide polymer to produce a multifilament, and drying and cutting the multifilament so that the fiber does not contain a spinning oil agent and water.

Hereinafter, an aramid pulp and a method for manufacturing the same according to embodiments of the present disclosure will be described in detail.

Prior to the description, unless otherwise specified throughout this specification, the technical terms used herein are only for reference to specific embodiments and are not intended to limit the present disclosure.

The singular forms "a", "an", and "the" used herein include plural references unless the context clearly dictates otherwise.

The term "including" or "comprising" as used herein specifies a specific feature, region, integer, step, action, element, and/or component, but does not exclude the presence or addition of a different specific feature, region, integer, step, action, element, component, and/or group.

Further, the terms including ordinal numbers such as "a first", "a second", etc. are used only for the purpose of distinguishing one component from another component, and are not limited by the ordinal numbers. For instance, a first component may be referred to as a second component, or similarly, the second component may be referred to as the first component, without departing from the scope of the present disclosure.

Further, as used herein, the aramid short fiber may include an aramid raw yarn.

Now, the present disclosure will be described in detail.

According to one embodiment of the present disclosure, there is provided an aramid pulp characterized in that it is formed from an oilless aramid short fiber of dried multifilaments that are not coated with a spinning oil agent.

In the present disclosure, the aramid raw yarn used in the production of an aramid pulp is not applied with a general spinning oil agent, and an oilless aramid raw yarn in a completely dried state is cut to a certain length and used, thereby being capable of reducing the water dispersion and swelling time as compared with a conventional case.

Therefore, the aramid pulp provided according to the one embodiment can shorten the pulping time and improve the productivity as compared with the conventional case, and has less generation of fiber floc during water dispersion, thereby enabling the production of highly fibrillated pulp focused on fibrillation (wet refining) rather than cutting (free refining).

Further, when using an oilless aramid raw yarn according to the present disclosure, there is no oil agent (oil component) on the fiber surface, so that the amount of fibrillation generated during pulping is maximized, and physical properties of pulp can be improved. In addition, in the present disclosure, there is no residual oil in the final pulp, so that interfacial adhesion force with various dissimilar materials can be maximized. Therefore, the aramid pulp can be applied to the manufacture of brakes, pads, and gaskets, which are the main applications, and thus can contribute to providing products with excellent physical properties. In particular, in the present disclosure, when using an oilless aramid raw yarn, the multifilament in a completely dried state is used, so that excellent physical properties (high strength, orientation, and crystallinity) of the raw yarn can be maintained.

Therefore, the final aramid pulp according to the one embodiment is better fibrillated than the conventional case, and can increase the specific surface area, so that the specific surface area may be 10 $m^2/g$ or more. More specifically, the specific surface area of the aramid pulp may be 10 to 20 $m^2/g$. Further, the aramid pulp of the present disclosure satisfies the above-mentioned specific surface area conditions, and at the same time, has freeness of 500 ml or less, thereby being capable of providing a pulp that is superior in fibrillation as compared with the conventional case. More specifically, a high-quality pulp in which the freeness of the aramid pulp is 100 to 500 ml and the fiber length (length-weighted average fiber length) is 0.3 to 1.5 mm can be provided. Such aramid pulp does not contain or hardly contains a residual oil agent in the final finished product. As an example, the aramid pulp may have a residual oil content of 0.1% or less in the pulp of the final product.

Hereinafter, the method for manufacturing an aramid pulp according to the one embodiment will be described in more detail with reference to the drawings.

FIG. 1 is a process diagram which briefly shows the process of producing an aramid filament according to an embodiment of the present disclosure.

According to another embodiment of the present disclosure, there can be provided a method for manufacturing the aramid pulp, the method including the steps of providing an oilless aramid short fiber; preparing a water dispersion slurry of the oilless aramid short fiber, and refining the water dispersion slurry, wherein the oilless aramid short fiber is produced by a method which includes spinning and coagulating a spinning dope using an aromatic polyamide polymer to produce a multifilament, and drying and cutting the multifilament, so that the fiber does not contain a spinning oil agent and water.

Therefore, according to an embodiment of the present disclosure, the step of providing an oilless aramid short fiber for producing an aramid filament is performed.

In the step of producing an aramid fiber using the aromatic polyamide polymer, after drying the multifilament that has undergone spinning and a coagulation bath, the dried multifilament can be cut and used without performing a step of applying a general spinning oil agent.

Specifically, the oilless aramid fiber can be produced through a process which includes a step of polymerizing an aromatic diamine and an aromatic diacid chloride in a polymerization solvent containing N-methyl-2-pyrrolidone to prepare a wholly aromatic polyamide, a step of dissolving the polymer in a concentrated sulfuric acid solvent to prepare a spinning dope, a step of spinning the spinning dope from a spinneret and coagulating the spun product using a coagulation bath to form a multifilament, and a step of washing and drying the multifilament.

The multifilament that has undergone such a process is in a state that does not contain a spinning oil agent and water, and has a feature of being directly used in a subsequent process. That is, the multifilament that has undergone the drying step can be cut into a certain length and applied to pulp production.

The step of forming the multifilament can use a method of passing the spun product through the coagulation liquid bath via a non-coagulating fluid layer (e.g., an air gap).

According to a more preferred embodiment, an aromatic polyamide polymer having an inherent viscosity (I.V.) of 5.0 to 7.0, for example, poly(paraphenylene terephthalamide: PPD-T), is provided using an aromatic diamine and an aromatic diacid chloride, which is dissolved in a concentrated sulfuric acid solvent, thereby preparing a spinning dope.

The spinning dope is spun using a spinneret 10 shown in FIG. 1 and then coagulated in a coagulation bath 20 via an air gap to form a multifilament.

Then, the sulfuric acid remaining in the obtained multifilament is removed. Most of the sulfuric acid used in the preparation of the spinning dope is removed while the spun product passes through the coagulation tank 20, but it may remain without being completely removed. Further, when sulfuric acid is added to the coagulation solution of the coagulation tank 20 so that sulfuric acid is uniformly discharged from the spun product, sulfuric acid is highly likely to remain in the obtained multifilament. Therefore, the sulfuric acid remaining in the multifilament may be removed by a washing step in the washing tank 30 containing water or a mixed solution of water and an alkaline solution.

After that, a drying step of removing water remaining in the multifilament 31 that has gone through the washing tank is performed in the drying unit 50 in which the drying roll 51 is installed. The dried multifilament is wound around a winder 60 to obtain an oilless aramid filament.

At this time, the physical properties of the raw yarn are determined through the drying step (heat treatment), and the dried multifilament must be a completely dried one. As an example, in the present disclosure, it is preferable to perform a complete drying step for the multifilament washed with water at a temperature condition of 100° C.

That is, the physical properties of the raw yarn are expressed during drying (heat treatment) after spinning. As the strength of the yarn is higher, the fibril and specific surface area of the pulp may be higher. However, if an aramid fiber that has not been completely dried at the time of spinning is used as a pulp raw material immediately after cutting, it may be difficult to express the physical properties of the raw yarn. Therefore, in the case of semi-dried or water-containing raw yarns, high-quality pulp with a specific surface area of 10 $g/m^2$ or more cannot be produced at the time of pulping, because of low strength, low orientation, low crystallinity, and the like.

In the case of semi-dried or water-containing fibers that have not been completely dried, they are in a swollen state, which causes a problem that the fibers cannot be cut to a predetermined length. In other words, since the swollen fibers are not in a normal raw yarn state, they are not cut with a cutting device (blade).

Therefore, in the present disclosure, since the raw yarn in a completely dried state is used for the production of pulp without applying an oil agent, it is possible to maintain the raw yarn strength superior to that of the conventional case. Therefore, in the present disclosure, the fibrillation can be improved to provide high-quality pulp with a specific surface area of 10 $g/m^2$ or more.

The oilless aramid filament is cut using a rotary cutter (not shown) to make into an aramid short fiber 1 having a length of about 1 to 12 mm. The length of the aramide short fiber 1 can be adjusted by adjusting the blade spacing of the rotary cutter. According to this method, the oilless aramid short fiber can be provided.

Following the above steps, an aramid pulp is manufactured using an oilless aramid short fiber. The aramid pulp can be manufactured by dissociating the aramid short fiber through the wet refining step.

Therefore, the method for manufacturing an aramid pulp according to the one embodiment performs the step of preparing a water dispersion slurry using an oilless aramid short fiber.

Further, optionally, before the step of preparing the water dispersion slurry, the method may further include the step of washing the aramid short fiber with a surfactant-containing washing solution. The type of the surfactant is not particularly limited, and all the nonionic, cationic, and anionic surfactants can be used. In the present disclosure, any type can be used, but from the viewpoint of washing efficiency, it may be more preferable to use anionic and cationic surfactants.

The step of preparing the water dispersion slurry of the aramid short fiber may include a dissociation step.

If the water dispersion of the aramid short fiber (raw yarn) is not smooth, there is a problem that raw materials are put by flock into a beater, causing equipment trouble (hunting), and sharply increasing the breakage of raw yarn. Therefore, in the present disclosure, by using the oilless yarn, the water dispersion can be smoothly performed without the above problems and without floating on the water.

The step of preparing the water dispersion slurry may include a step of dissociating the aramid short fiber in water at room temperature for 10 minutes or more and 120 minutes or less to swell an aramid short fiber. In such a case, when the dissociation time is less than 10 minutes during the production of the water dispersion slurry, swelling of the aramid short fiber does not occur, and when the time is 120 minutes or more, it is problematic in terms of productivity.

Further, the swelling degree of the aramid short fiber in the water dispersion slurry can be changed depending on variables such as the temperature of water, immersion time, and the presence or absence of an oil agent of the raw yarn. However, the degree of swelling of the oilless fiber of the present disclosure may be more excellent because the short fiber can be dissociated within a shorter time relative to the oil agent.

That is, it is known that the raw yarn becomes flexible through swelling, and generally, the higher the degree of swelling, the more advantageous for pulping. However, with respect to the water dispersion slurry obtained by the method of the present disclosure, when the oilless aramid short fiber in the slurry is confirmed with an optical microscope, the degree of fiber swelling (diameter) is improved as compared with the conventional case, and when the same production conditions are applied, the fibrillation development of the final pulp may be excellent.

According to one embodiment, when using the method of immersing the aramid short fiber in water for about 60 minutes during the water dispersion, the oilless aramid short fiber swollen in the water dispersion slurry may have a swelling degree of about 102% or more, or about 105% or more relative to the swelling degree of the oilless aramid short fiber before swelling.

Further, when the aramid slurry is formed by the dissociation step, a step of wet refining the aramid slurry is performed.

Specifically, the wet refining step is one of the important steps for determining the freeness (Canadian Standard Freeness) of the aramid pulp. This is because the degree of fibrillation of aramid short fibers through the refining step shows a large difference in the freeness of aramid pulp. That is, if the degree of fibrillation is excellent, the freeness of the pulp is lowered, which means that the dispersibility of the aramid pulp is excellent. On the other hand, if the degree of fibrillation is poor, the freeness of the pulp becomes higher, which means that the quality of the aramid pulp is poor.

Therefore, the refining step is a step of making the oilless aramid short fibers contained in the water dispersion slurry more well dispersed so that fibrillation are smoothly formed, respectively. If the oilless aramid short fibers are not well dispersed and formed into floc in the dissociation step, the surface area is reduced, and thus the step proceeds focused on the cutting (free refining) during the refining, and the fibrillation development (wet-refining) is not performed, so that it may be difficult to manufacture a highly fibrillated pulp.

However, the method of manufacturing an aramid pulp according to the one embodiment uses an oilless aramid short fiber (raw yarn), and thus is excellent in water dispersibility when dispersing in water and is reduced in the swelling time, whereby there is no floc property of fibers and fibrillation can be maximized.

After the step of refining, the step of dehydration and drying may be further included. For example, the aramid short fibers may be fibrillated in the refining step, then dehydrated by a well-known method, and dried (heat treated) using a hot air dryer.

Further, optionally, when mass-producing aramid pulp at the factory, after the refining step, it may include a step of preparing an aramid pulp according to a well-known method. As an example, after the refining step, it may further include a sheet making step, a sheet drying step, and a sheet crushing step.

In the method for manufacturing the aramid pulp according to the one embodiment, the refining step, the sheet making step, the sheet drying step, and the sheet crushing step may be performed according to methods that are well known in the art.

FIG. 2 is a process diagram which briefly shows the process of manufacturing an aramid pulp according to another embodiment of the present disclosure.

As shown in FIG. 2, according to the one embodiment, the oilless aramid short fibers 1 are put into a washing tank 180, and then the washed oilless aramid short fibers are transferred to a dissociation unit 110 to prepare a water dispersion slurry. The water dispersion slurry contains oilless aramid short fibers in a swollen state, and such a water dispersion slurry is transferred to a refining unit 120, a sheet forming unit 130, a press unit 140, a drying unit 150, a crushing unit 160, and a packaging unit 170.

The oilless aramid short fibers 2 fibrillated through the refining step described above are made into a sheet 3 by a sheet forming unit 130, and then water is primarily removed from the sheet 3 through a squeezing step.

The water removal may be performed in a press unit 140 composed of two upper and lower rolls.

The sheet 4 from which water has been primarily removed by the press unit 140 is dried in a drying unit 150 so that water can be secondarily removed.

Then, the dried sheet 5 is crushed in a crushing unit 160 to produce the final aramid pulp 6.

The final aramid pulp 6 produced in this manner may be compressed and packaged in a predetermined unit in a wrapping unit 170 and then transferred to a destination.

Further, according to one embodiment, the aramid pulp may have freeness of 500 ml or less, a specific surface area of 10 $m^2/g$ or more, and a residual oil content in the pulp of the final product of 0.1% or less.

Specifically, the aramid pulp produced according to the above process may be increased in the specific surface area as compared with the conventional case. In one example, according to the present disclosure, an aramid pulp having a specific surface area of 10 $m^2/g$ or more can be provided. More preferably, the specific surface area of the aramid pulp may be 10 to 20 $m^2/g$.

Further, the aramid pulp does not contain an oil agent, and may have freeness of 500 ml or less or 100 to 500 ml, and a fiber length (length-weighted average fiber length) of 0.3 to 1.5 mm. At this time, at the time of evaluating the freeness, in order to perform the evaluation according to the presence or absence of an oil agent of aramid short fibers, the results using a laboratory beater (valley beater) show that the freeness may be slightly higher. However, the freeness of the aramid pulp in the case of using a general beater for mass production may be 500 ml or less or 100 to 500 ml.

Such aramid pulp has excellent dispersibility and excellent interfacial adhesion force when complexed with dissimilar materials such as polymer resins, thereby improving compatibility and providing products with uniform physical properties.

In addition, the aramid pulp according to the one embodiment may provide an effect of improving the bending strength for a product molded by using it.

Advantageous Effects

According the present disclosure, there can be provided a method for manufacturing an aramide pulp, in which, at the time of producing a slurry using an oilless yarn, the productivity is improved by reducing water dispersion and swelling time compared to before, and can improve the product quality deviation and thus improve the physical properties. In addition, in the present disclosure, it has no residual oil agent in the final pulp, and has excellent interfacial adhesion force between dissimilar materials and aramid pulp, which can contribute to improving the physical properties of brake pads and gaskets.

BRIEF DESCRIPTION OF THE DRAWINGS

FIG. 1 is a process diagram which briefly shows the process of producing an aramid filament according to an embodiment of the present disclosure.

FIG. 2 is a process diagram which briefly shows the process of manufacturing an aramid pulp according to another embodiment of the present disclosure.

FIG. 3 is a result of visually observing the water dispersibility of Example 1 and Comparative Example 1.

FIGS. 4*a* and 4*b* are the results of observing the fiber swelling degree of Example 1 and Comparative Example 1 with an optical microscope.

FIG. 5 is a refining degree evaluation result with respect to Example 1 and Comparative Example 2.

FIG. 6 is an orientation evaluation result with respect to Example 1 and Comparative Example 2.

DETAILED DESCRIPTION OF THE EMBODIMENTS

Hereinafter, the actions and effects of the invention will be described more specifically with reference to specific examples of the present disclosure. However, the examples are for illustrative purposes only, and are not intended to limit the scope of rights of the invention in any sense.

Example 1

1) Production of Aramid Short Fiber $CaCl_2$) was added to N-methyl-2-pyrrolidone (NMP) to prepare a polymerization solvent, and then para-phenylenediamine was dissolved in the polymerization solvent to prepare a mixed solution.

Then, while stirring the mixed solution, the same number of moles of terephthaloyl dichloride as para-phenylenediamine was added to the mixed solution in two divided portions to produce a poly(paraphenylene terephthalamide) polymer. Water and NaOH were then added to the polymerization solution containing the polymer to neutralize acid. Then, the polymer was pulverized, and the polymerization solvent contained in the aromatic polyamide polymer was extracted using water, and subjected to dehydration and drying steps to finally obtain an aromatic polyamide polymer.

Then, the obtained aromatic polyamide polymer was dissolved in 99% concentrated sulfuric acid to prepare a spinning dope. The polymer concentration in the spinning dope was set to 20 wt %.

The spinning dope was spun through a spinneret, and solidified in a coagulation tank containing a 13% aqueous sulfuric acid solution through a 7 mm air gap. Thereby, an aramid multifilament composed of 1000 monofilaments were produced.

The produced multifilament was washed with water, dried, and wound to produce an aramid fiber having a linear density of 1500 denier. At this time, the drying was performed by hot air drying at 100° C.

Then, the aramid fiber to which the oil agent was not applied was cut using a rotary cutter to make an aramid short fiber (oilless aramid raw yarn).

2) Manufacture of Aramid Pulp

The oilless aramid short fiber (aramid yarn) was put in water, circulated for 10 minutes, and dispersed, and the refining was performed immediately for 60 minutes using a valley beater, which is a laboratory beater. The aramid short fiber swollen in this process could be obtained.

That is, the oilless yarn was beaten using the valley beater, which is a laboratory beater. The refining conditions were a 0.6% concentration, 1 hour, and a load of 10 kg.

After input to the refining section, it was beaten for 60 minutes to produce fibrillated aramid short fibers 2 having an average length of 1 mm.

After the refining, dehydration was performed using a centrifugal dehydrator, and dried for about half a day (12 hours) at 100° C. in a hot air dryer to manufacture an aramid pulp.

Comparative Example 1

The process was performed in the same manner as in Example 1, except that during the production of the aramid short fiber, a spinning oil agent was applied to the multifilament having a linear density of 1500 denier.

That is, a first oil agent containing ester oil and a second oil agent containing phosphate ether oil were sequentially passed through the multifilament, and then crimped so that the average number of crimps was 3 crimps/cm.

Comparative Example 2

Aramid pulp was manufactured in the same manner as in Example 1, except that during the production of the aramid short fiber, drying (heat treatment) was not performed.

Experimental Example 1

The physical properties of Example 1 and Comparative Example 1 were evaluated by the following methods.

That is, in order to compare the effects of aramid short fibers on the presence or absence of the oil agent, it is a comparison of the results using a laboratory beater (valley beater) at room temperature for 10 minutes.

(1) Evaluation of Fiber Water Dispersion

The water dispersion evaluation during the production of the aramid short fiber water dispersion slurry of Example 1 and Comparative Example 1 was observed with the naked eye, and the results are shown in FIG. 3.

As shown in FIG. 3, it can be confirmed that Example 1 using the oilless aramid raw yarn of the present disclosure was very excellent in dispersibility as compared with Comparative Example 1 using the conventional yarn containing an oil agent.

That is, the result of observation with the naked eye after the water dispersion of the raw yarn showed that in Example 1, the raw yarn was smoothly dispersed without floating due to the oilless.

On the other hand, the existing raw yarn of Comparative Example 1 floated due to the oil agent, and the fiber floc was not broken.

(2) Fiber Swelling Degree

The oilless raw yarn of Example 1 and the oil agent-applied raw yarn of Comparative Example 1 were immersed in water, then the diameter was measured through an optical microscope, and a difference in swelling degree (increase in diameter) was confirmed. The results are shown in FIGS. 4*a* and 4*b*. In FIGS. 4*a* and 4*b*, a to *e* indicate the fiber length of the indicated section.

The oilless raw yarn of Example 1 of FIG. 4*a* was immersed in water and observed through an optical microscope. As a result, the swelling degree after 60 minutes of immersion was 105.0% relative to before immersion.

However, the conventional raw yarn of Comparative Example 1 of FIG. 4*b* showed a swelling degree of 101.7% after 60 minutes of immersion, which was inferior to that of Example 1.

(3) Canadian Standard Freeness (CSF: Ml)

After refining, the pulp made from the oilless yarn/oil agent-applied yarn of Example 1 and Comparative Example 1 was completely dried and then dissociated using a standard dissociator, and then the freeness was measured. The freeness evaluates the dehydration of pulp, and generally, it is evaluated as an excellent pulp if the dehydration is poor (the freeness value is low). The results are shown in Table 1.

That is, in accordance with the TAPPI 227 evaluation regulations, 3 g/L of pulp was dissociated for a certain period of time using a standard dissociator, then put into the freedom tester specified in the above regulations, and then the amount of overflowing water was measured to qualitatively evaluate the degree of fibrillation of the pulp.

(4) Fiber Length (Fiber Weighted Average Fiber Length)

After refining, the pulp made from oilless yarn/oil agent-applied yarn was measured with a Valmet FS300, which is a fiber length measuring machine.

(5) Filler Retention: F/R

F/R is a method of evaluating the fibrils of pulp. The pulp and the filler were mixed and sieved, and the degree to which the pulp holds the filler was evaluated. In general, it was judged that the higher the value, the better the pulp with well-developed fibrils.

(6) Temporary Molding/Bending Strength

Temporary molding/bending strength is a method of evaluating the reinforcing performance of pulp. The pulp and the filler were mixed, and then temporarily molded using a press facility to produce a pad.

The bending strength of the produced pad was measured to evaluate the reinforcing performance of the pulp. At this time, the bending strength was evaluated by measuring the force (resistance force) of resisting bending by modifying the plastic-bending measurement standard according to KS M ISO 178 (unit: kgf)

As a result of the temporary molding/bending strength evaluation, it was found that the pulp using the oilless raw yarn was about 58% higher (excellent).

(7) Specific Surface Area ($m^2/g$)

The specific surface area of the sample was quantitatively measured according to a well-known BET evaluation method.

TABLE 1

| | Comparative Example 1 | Example 1 | Remarks (Example 1/ Comparative Example 1) |
|---|---|---|---|
| Water dispersion (naked eye) | Poor | Excellent | — |
| Swelling (%) | 101.7 | 105.0 | 3% |
| Freeness (ml) | 704 | 665 | −6% |
| Fiber length (mm) | 0.96 | 0.90 | −7% |
| F/R (%) | 15.2 | 15.7 | 3% |
| Bending strength (kgf) | 0.36 | 0.57 | 58% |
| Specific surface area ($m^2/g$) | 7 | 12 | 71% |

Looking at Table 1, it was confirmed that the pulp using the oilless aramid short fiber (yarn) of Example 1 is excellent in pulping as compared with Comparative Example 1, and is excellent in interfacial adhesion force with dissimilar materials in the final product.

That is, as described above, it was shown that Example 1 is excellent in water dispersibility and swelling degree as compared with Comparative Example 1, and the specific surface area is high at about 12 $m^2/g$.

The fiber length results also showed that Example 1 is about 7% shorter than Comparative Example 1. The fiber length being short can be interpreted as causing a lot of refining. Therefore, in the case of the present disclosure, the refining can be easily performed, and pulp performance can be improved.

The freeness evaluation results showed that the freeness of the pulp using the oilless aramid short fiber (yarn) of Example 1 is about 6% lower (excellent) than Comparative Example 1. The freeness evaluates the dehydration properties of the pulp, and generally, it can be evaluated as an excellent pulp if the dehydration property is poor (the freeness value is low).

The F/R evaluation result showed that the F/R of the pulp using the oilless aramid short fibers (raw yarn) of Example 1 was about 3% higher (excellent) than that of Comparative Example 1.

The temporary molding/bending strength evaluation result showed that the pulp using the oilless aramid short fiber (raw yarn) of Example 1 is about 58% higher (excellent) than that of Comparative Example 1.

Further, the above evaluation result is the result of using a laboratory beater (valley beater), and the freeness of the pulp using a general factory beater may be 500 ml or less or 100 to 500 ml.

On the other hand, Comparative Example 1 has no peculiarities observed with the naked eye in the refining as compared with Example 1, but the fiber length was long, the freeness was high, and the F/R value was low as compared with the oilless aramid short fiber (raw yarn) of Example 1. This means that Comparative Example 1 is deficient in the degree of pulping as compared with Example 1. Further, the temporary molding/bending strength value of Comparative Example 1 is lower than that of Example 1. In Comparative Example 1, the oil agent of the pulp interferes with the adsorption of $N_2$ when the specific surface area is evaluated, and the evaluation result is decreased to about 7 $m^2/cm$ (decreased in interfacial adhesion force). This can be judged that the pulp oil agent lowers the interfacial adhesion force with different materials, and ultimately adversely affects the physical properties of the finished product.

Therefore, it was confirmed that the oil agent coated on the aramid yarn interferes with the pulping, and finally remains in the pulp to lower the interfacial adhesion force with the dissimilar materials.

Experimental Example 2

At the time of providing the aramid short fibers (aramid raw yarns) used in Example 1 and Comparative Example 2, the refining evaluation was performed according to the presence or absence of drying, and the results are shown in FIGS. 5 and 6.

FIG. 5 is a refining degree evaluation result with respect to Example 1 and Comparative Example 2. FIG. 6 is an orientation evaluation with respect to Example 1 and Comparative Example 2.

Further, Comparative Example 2 in FIGS. 5 and 6 is a result of using a fiber in a state in which the aramid short fibers are in a wet state of not being dried. Further, Example 1 is the result of using the fiber after the aramid fiber is completely dried through normal drying.

The refining degree evaluation is the result after 1.5 h at pH7 and pH12, respectively, after the refining step with a valley beater for each aramid short fiber, and the structure of the fibers was measured by optical electron microscopy.

Further, when evaluating the fiber structure, general XRD was used to measure the orientation angle, crystallinity, size, and the like of the fiber.

Looking at FIGS. 5 and 6, in the case of Comparative Example 1, as an aramid raw yarn that was not dried (heat treated) after spinning was used, there was a significant difference from Example 1 in the fibril expression level before and after refining.

That is, Comparative Example 2 using the aramid fibers that have been subjected to abnormal drying in FIG. 5 showed weak fibril expression after refining. As a result, as shown in FIG. 6, in Comparative Example 2, the fibers were in a wet state before refining, and thus, after the refining step, the fibril expression was very weak, and even if it showed a fibrous structure with a diameter of 85 μm, XRD could not be measured.

Therefore, Comparative Example 2 is significantly inferior in the refining performance due to low orientation, crystallinity, and structure after refining, as compared with Example 1 using the dried (heat-treated) oilless aramid yarn.

On the other hand, in the case of Example 1, the aramid fibers were completely dried and then used in an oilless state to form a fibrous structure in which fibril expression was very strong after the refining step. Thereby, in the case of the present disclosure, it exhibits a fibrous structure in which the fiber orientation angle measured by XRD is 7 to 12°, the crystallinity is as high as 75%, and the diameter is 12 μm.

Therefore, when using fibers that have not been dried (heat treated) during the production of aramid pulp, the fiber structure (skin-core) is incomplete, and fibrils are not easily generated at the time of refining under the same conditions due to a low degree of orientation/crystallization. From these results, it was confirmed that as the present disclosure uses an oilless aramid yarn that has been completely dried through heat treatment as compared with the conventional case, it exhibits excellent orientation/crystallinity without the problems such as incomplete fiber structure, so that high quality aramid pulp having improved fibrillation can be produced.

DESCRIPTION OF REFERENCE NUMERALS

1: aramid short fiber
2: fibrillated aramid short fiber
3: sheet
4: dehydrated sheet
5: dried sheet
6: aramid pulp
110: dissociation unit
120: refining unit
130: sheet forming unit
140: press unit
150: drying unit
160: crushing unit
170: packaging unit
10: spinneret
20: coagulation bath
30: washing tank
31: multifilament
50: drying unit
51: drying roll
60: winder

The invention claimed is:

1. A method for manufacturing an aramid pulp, the method comprising the steps of:

providing an oilless aramid short fiber;

preparing a water dispersion slurry of the oilless aramid short fiber; and refining the water dispersion slurry, wherein the oilless aramid short fiber is produced by a method which comprises spinning and coagulating a spinning dope using an aromatic polyamide polymer to produce a multifilament, and drying and cutting the multifilament, so that the fiber does not contain a spinning oil agent and water, wherein the step of preparing the water dispersion slurry comprises a step of dissociating the oilless aramid short fiber in water for 10 minutes or more and 120 minutes or less at room temperature to swell the oilless aramid short fiber.

2. The method for manufacturing the aramid pulp of claim 1, wherein the oilless aramid short fiber swollen in the water dispersion slurry has a swelling degree of 102% or more relative to the oilless aramid short fiber before swelling.

3. The method for manufacturing the aramid pulp of claim 1, which further comprises a step of washing the oilless aramid short fiber with a surfactant-containing washing solution, before the step of preparing a water dispersion slurry.

4. The method for manufacturing the aramid pulp of claim 1, which further comprises a sheet making step, a sheet drying step, and a sheet crushing step, after the refining step.

5. The method for manufacturing the aramid pulp of claim 1, wherein freeness is 500 ml or less, a specific surface area is 10 $m^2/g$ or more, and a residual oil content in the pulp of the final product is 0.1 wt. % or less.

* * * * *